United States Patent [19]

Midorikawa

[11] 4,086,312

[45] Apr. 25, 1978

[54] WRITING PEN CORE HAVING AN INTEGRAL NIB AND INK RESERVOIR AND METHOD OF MANUFACTURE

[75] Inventor: Yoshio Midorikawa, Tokyo, Japan

[73] Assignee: Glasrock Products, Inc., Fairburn, Ga.

[21] Appl. No.: 702,067

[22] Filed: Jul. 2, 1976

[30] Foreign Application Priority Data

Apr. 8, 1976 Japan ..... 51-38709

[51] Int. Cl.[2] ..... D04H 1/64

[52] U.S. Cl. ..... 264/46.6; 264/54; 264/DIG. 5; 264/DIG. 13; 264/128

[58] Field of Search ..... 264/128, 136, 54, 45.3, 264/46.4, 46.6, DIG. 5, DIG. 13; 401/198

[56] References Cited

U.S. PATENT DOCUMENTS

| | | | |
|---|---|---|---|
| 3,400,998 | 9/1968 | Daugherty et al. | 401/198 |
| 3,432,446 | 3/1969 | Coppeta | 260/2.5 |
| 3,443,984 | 5/1969 | Stewart | 117/94 |
| 3,461,197 | 8/1969 | Lemelson | 264/172 |
| 3,502,417 | 3/1970 | Hartmann | 401/202 |
| 3,558,392 | 1/1971 | Goodenow et al. | 401/198 |
| 3,562,374 | 2/1971 | Okamoto et al. | 264/128 |
| 3,715,254 | 2/1973 | Tolgyesl | 156/180 |
| 3,767,520 | 10/1973 | Dick et al. | 401/198 |
| 3,864,183 | 2/1975 | Hori | 401/198 |
| 3,881,828 | 5/1975 | Jones | 401/199 |
| 3,942,903 | 3/1976 | Dickey et al. | 401/198 |

FOREIGN PATENT DOCUMENTS

| | | |
|---|---|---|
| 800,211 | 12/1968 | Canada. |
| 1,418,087 | 10/1965 | France. |
| 1,561,844 | 5/1967 | Germany. |
| 26,687 | 11/1969 | Japan. |

*Primary Examiner*—Jan H. Silbaugh
*Assistant Examiner*—James R. Hall
*Attorney, Agent, or Firm*—Lane, Aitken, Dunner & Ziems

[57] ABSTRACT

A fiber bundle is first formed of entangled fibers by passing fibers through the tapered mole of an extruder, and then the fiber bundle is provided with at least one longitudinal groove which provides an air passage in the final product communication between the ink reservoir and the atmosphere. Subsequently, one end of the fiber bundle with the longitudinal groove is dipped into a liquid urethane prepolymer to form a nib portion by impregnating the dipped portion with the prepolymer. After removal from the liquid prepolymer it is left to stand. During this standing or setting period the reactions among the constituents of the prepolymer and the volatilization of solvent produce a set urethane nib portion having capillary passages therein, and an air passageway where the groove was formed. The fiber bundle thus produced which is called "core portion" of the pen, is machined at its impregnated end to form a nib. Thus, the product consists of a nib material portion and an ink reservoir integral therewith.

5 Claims, 4 Drawing Figures

WRITING PEN CORE HAVING AN INTEGRAL NIB AND INK RESERVOIR AND METHOD OF MANUFACTURE

BACKGROUND OF THE INVENTION

The present invention relates to a pen core having a nib material portion and an ink reservoir integral therewith, and to a method of manufacturing same. More particularly, the present invention relates to such a pen core including at least one air passage extending along its length, and to a method of manufacturing same.

PRIOR ART

In a nib pen of the type including an ink reservoir, it is necessary for the ink reservoir to communicate with the atmosphere. Lack of communication of the ink reservoir with the atmosphere causes ink to be forced out around an end plug when a head cap is fitted, or to be prematurely drawn out of the nib when the head cap is removed, furthermore to flow excessively from the nib owing to the expansion of air in the ink reservoir when the pen is in hand during lack of such communication can also cause the ink supply to stop writing owing to back pressure after a substantial amount of ink consumption. In order to prevent these undesirable effects the pen is usually provided an air passage communicating with the atmosphere. However, it has remained a troublesome problem to provide a nib having such an air passage formed therein, and in fact such a nib of suitable appearance has not previously been developed.

SUMMARY OF THE INVENTION

A object of the present invention is to provide a method for making a nib-type writing pen core having one or more air passages formed to extend from a nib portion to an ink reservoir integral therewith.

Another object of the present invention is to provide a method of producing a nib-type pen wherein an air vent or hole may be formed simply by a single process step at a very low cost.

According to the present invention, at the same time fibers are compressed and formed into a fiber bundle by use of a suitable tool such as a tapered die the fiber bundle is provided along its length with at least one groove having a desirable configuration by a protrusion provided inside the die, the groove serving as an air vent or passage.

By making the area of the die adjacent to the protrusion higher in temperature, a positive profiling of the fiber bundle to form the groove may be ensured. The fiber bundle is covered with an outer shell or sheath of a material such as vinyl chloride.

Subsequently, one end of the fiber bundle, having the groove, is dipped into liquid urethane prepolymer. The fiber bundle thus filled with urethane prepolymer is removed from the liquid urethane prepolymer and is left to stand for a period of time during which it may be heated.

While standing, the solvent in the prepolymer first volatilizes and then prepolymer polymerizes to form a capillary body. When the fiber bundle is dipped into the urethane prepolymer, the groove is also filled with urethane prepolymer, but after removal from the urethane prepolymer, the liquid prepolymer in the groove will be absorbed into the core portion by capillary action.

Accordingly, in the present invention no air hole need be formed in either the outer shell (sheath) or the end plug, rather an air passage is formed in a single step, resulting in a reduction in cost for the outer shell and a saving of material and furthermore in excellent appearance and good writing touch of the finished pen.

DESCRIPTION OF THE DRAWINGS

IN THE DRAWINGS

Figure 1:
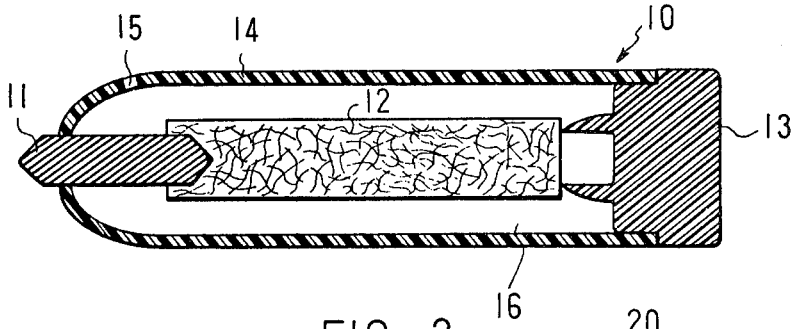
FIG. 1 PRIOR ART
Figure 2:
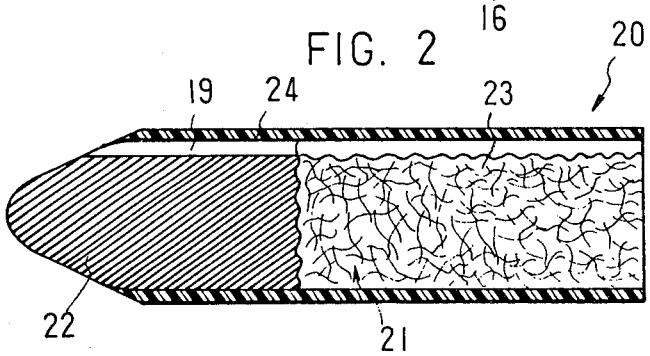
Figure 3:
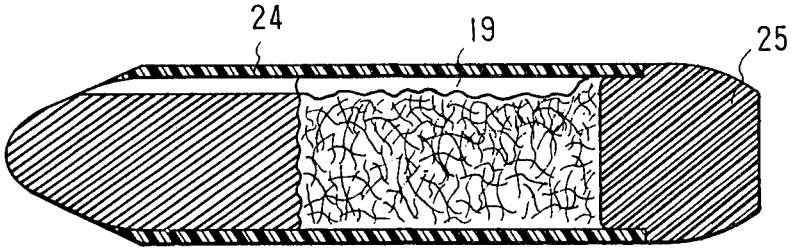
Figure 4:
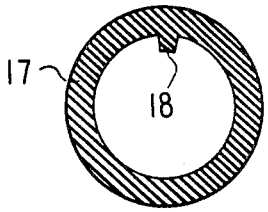

FIG. 1 is a longitudinal cross-section of a prior art nib-type pen;

FIG. 2 is a longitudinal cross-section of a pen according to the present invention prior to the installation of an end plug;

FIG. 3 is a view similar to FIG. 2 of the finished pen according to the present invention; and FIG. 4 is a front view of a die for forming the core portion of the pen according to the present invention.

PREFERRED EMBODIMENTS

In the drawing corresponding parts are designated by the same reference numerals.

FIG. 1 shows a conventional nib-type pen illustrated generally at 10, which comprises a nib portion 11, ink reservoir 12 in which the nib portion is planted or embedded at one end, an end plug 13 supporting the ink reservoir, and an outer shell or sheath 14. Usually the outer shell 14 is provided with at least one air vent for communication between an air chamber 16 and the atmosphere so that atmospheric pressure is provided in the ink reservoir 12. This prior art arrangement requires four components, and the provision of the air hole in the outer shell detracts from appearance.

In accordance with the present invention, a nib-type pen is constructed so that the ink reservoir 12 and the nib portion 11 are completely integral and an air vent is formed extending from the nib portion to the ink reservoir which itself forms the air chamber.

First, fibers such as polyester are compressed and formed by a die 17 as shown in FIG. 4 into the fiber bundle. At the same time, a protrusion 18 provided inside the die forms a groove along the outer surface of the fiber bundle. To ensure that a positive profiling of the groove, the protrusion 18 may be at a higher temperature than other portions of the die. Therefore, the inside surface of the die other than protrusion may have a Teflon coating. The groove thus formed provides an air vent or passage 19. The fiber bundle is cut to a suitable length and treated as described above to form a core portion 21 of the pen 20. The fiber bundle is provided with an outer shell or sheath 24 of a suitable material at the time of formation of the fiber bundle or thereafter. For this material vinyl chloride is preferred.

Subsequently, the fiber bundle is cut to a suitable length and one end portion is dipped into a liquid urethane prepolymer, whereby the small spaces in the fiber bundle are impregnated with urethane prepolymer. The fiber bundle with urethane prepolymer impregnated therein is removed from the urethane prepolymer and left to stand. At that time it may be heated to a higher temperature, above 40° C.

The finished core portion 21 consists of a treated or set portion 22 and an untreated portion 23. The untreated portion 23 serves as both an ink reservoir and an air chamber.

The urethane prepolymer is a reaction mixture including isocyanate (polyisocyanate), polyol, solvent, water, and a reaction promoting agent. The urethane prepolymer may include a gas generating agent such as $(NH_4)_2HCO_3$,$(NH_4)_2CO_3$, or

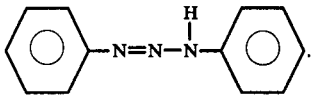

As the urethane prepolymer impregnated in the fiber bundle is heated, the solvent volatilizes and then the isocyanate (polyisocyanate) reacts with the polyol to produce polyurethane and simultaneously with water to generate carbon dioxide gas. The volatilized gas and carbon dioxide gas thus generated form capillary passages in portion 22 which is subsequently formed into a nib.

When the fiber bundle is dipped into urethane prepolymer, the groove 19 is also filled with urethane prepolymer. However, the urethane prepolymer in the groove is absorbed into the fiber bundle portion owing to the capillary action of the fiber in the fiber bundle. As a result, the groove in the portion dipped into urethane prepolymer remains intact.

The capillary passages in dipped portion 22 consist of the primary relatively large passages formed due to the volatilization of the solvent and the secondary relatively small passages formed due to the generation and escape of carbon dioxide gas. The combined formation of both types of passages provides suitable elasticity and ink transudation action for the capillary portion.

Then, the core portion 21 consisting of the fiber bundle, one end of which has been treated and hardened, and the outer shell or sheath 24 are machined to form a cone-shaped nib portion. Ink is injected into the ink reservoir, and then an end plug is urged into the core portion 21 from the side opposite to the nib portion to complete the pen. Then, the surface of the end plug is preferably sealed to prevent the leakage of ink.

When the end plug is inserted the air vent in untreated portion 23 is collapsed and folded, and the untreated fiber bundle portion 23 serves as a chamber retaining ink and air among the fibers. Usually, air occupies 40% of the volume of the core portion, as a result of which there is no need for provision of a separate air chamber.

The above-described arrangement permits communication of ink reservoir-air chamber with the atmosphere through the air vent 19 without requiring a separate air vent in the outer shell or end plug as has heretofore been required. This provides excellent appearance and enables manufacture of the pen in a relatively simple process which is the important factor in providing a more economical pen.

Several examples for urethane prepolymers used in the present invention will be described in the following:

| Example 1 | Parts by Weight |
|---|---|
| Polyol 807 | 100 |
| Isocyanate TD1-65 | 6.3 |
| $H_2O$ | 3 - 8 |
| dichloroethane (solvent) | 150 |
| ethylene diamine (catalyst) | a trace |

| Example 2 | |
|---|---|
| Polyol 3030 | 100 |
| Isocyanate TD1-80 | 50 - 100 |
| dichloroethane (solvent) | 150 - 200 |
| $H_2O$ | 3 - 8 |

| Example 3 | |
|---|---|
| Polyol 3030 | 100 |
| Isocyanate TD1-65 | 50 - 100 |
| dichloroethane (solvent) | 150 - 200 |
| $H_2O$ | 3 - 8 |

| Example 4 | |
|---|---|
| Polyol 807 | 100 |
| Isocyanate TD1-65 | 9.52 |
| $H_2O$ | 3 - 8 |
| dichloroethane (solvent) | 150 |
| DABCO 33LV (Catalyst) | 0.3 |

| Example 5 | |
|---|---|
| Polyol 3030 | 100 |
| Isocyanate TD1-80 | 9.58 |
| $H_2O$ | 3 - 8 |
| dichloroethane (solvent) | 150 |
| DABCO 33LV } (catalyst) | 0.3 |
| Octyl Stanate } (catalyst) | 0.3 |

The chemical features of the various components of the prepolymers listed above are described in Tables I, II and III.

TABLE 1

| Polyol | The Number of OH groups | M.W. | OH Value mg/g |
|---|---|---|---|
| (A) 3030 | 3 | 3,000 | 56 |
| (B) 2020 | 2 | 2,000 | 56 |
| (C) 202 | 3 | 3,000 | 56 |
| (D) 807 | 3 | 6,500 | 36.8 |
| (E) 3758 | 8 | 500-600 | 375 |
| (F) 530SA | 3 | 500-600 | 530 |

TABLE II

| Isocyanate | NCO % |
|---|---|
| (a) TD1-65 | 45 - 47 |
| (b) TD1-80 | 48.3 |
| (c) MD1-CR | 30.0 - 32.0 |
| (d) MD1-PAPI | 31 |

TABLE III

| Polyol | Isocyanate (a) TD1-65 | (b) TD1-80 | (c) MD1-CR | (d) MD1-PAPI |
|---|---|---|---|---|
| (A) 3030 | 9.58 | 9.13 | 14 | 14.22 |
| (B) 2020 | 9.58 | 9.13 | 14 | 14.22 |
| (C) 202 | 9.58 | 9.13 | 14 | 14.22 |
| (D) 807 | 6.3 | 6 | 9 | 9.34 |
| (E) 3758 | 64.20 | 61.14 | 95 | 95.26 |
| (F) 530SA | 90.73 | 86.41 | 134 | 134.63 |

The data of Table III shows equivalents of isocyanate with respect to 100 parts of polyol.

Equivalent of isocyanate with respect to polyol =

$$\frac{0.075 \times \text{OH value} \times \text{Polyol (parts)}}{\text{NCO (wt \%)}}$$

In the above Tables, TD1 means a mixture consisting of 20 weight % of

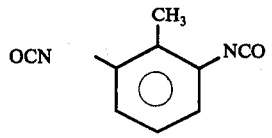

and 80 weight % of

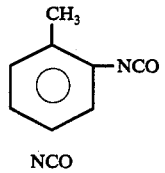

and MD1 means a material having the following chemical formula

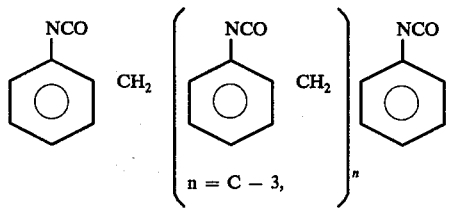

and having a mean number of 2.6 – 2.8 of NCO groups.

The prepolymer as described above is preferably prepared in the following manner. First, the polyol and isocyanate are mixed with the solvent at a predetermined ratio as listed above, for example. However, the present invention is not restricted to such ratios as such and it has been found that the prepolymer might include five times or so the indicated amounts of solvent listed above to enable shorter drying and finishing periods and for lower heating temperatures, for example 40–80 degrees centigrade. The polyol is not restricted to those listed in the above Tables; rather, any type of polyol may be used. Finally, a small amount of water and catalyst are added.

A suitable catalayst is available in the market under the trademark of DABCO and has the following chemical fomula:

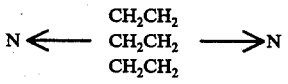

The fiber bundle is suitably made of fibers having a thickness of about 3 denier (3.5 – 7g/m). As shown in Table 1 the polyol preferably has three functional groups but may also have different numbers.

The use of a catalyst, for example, DABCO will shorten the setting period during which polyurethane is produced.

In the present invention any polyol may be used but the polyol having following chemical formulas is preferred.

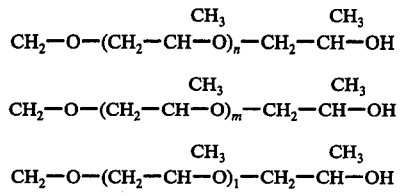

n,m 1 = 16 – 17
N.W. = 3000

In conclusion the present invention provides a novel pen including a nib portion, and an ink reservoir integral therewith, having at least one groove extending from the nib portion to the ink reservoir which serves as an air vent or passage.

I claim:

1. A method for producing a writing pen core having an integral nib material and ink reservoir comprising:
   (a) passing a plurality of fibers through a die to compress and form said fibers into a bundle, said die having an internal protrusion thereby forming a longitudinal channel along the length of the bundle;
   (b) forming a plastic sheath around said fiber bundle; then
   (c) impregnating a first portion of the length of said fiber bundle with a solution of a urethane prepolymer, leaving a second portion or length of said fiber bundle untreated; and
   (d) allowing said resin in said first portion of said fiber bundle to set whereby the gases generated by volatization of the solvent and by the setting of the polymer form capillary passages in said first portion of said bundle, thus forming a nib material portion integral with said untreated second portion.

2. The method of claim 1 wherein said internal protrusion of said die is heated to a temperature higher than that of the remainder of the die to ensure positive profiling of the longitudinal channel.

3. The method of claim 1 wherein said prepolymer includes isocyanate, polyol, solvent, water and a catalyst.

4. The method as claimed in claim 3 wherein said urethane prepolymer further includes a gas generation agent selected from the group consisting of $(NH_4)HCO_3$, $(NH_4)_2CO_3$ and

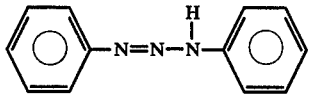

5. The method of claim 1 wherein said first portion is heated to a temperature of more than 40° C during step (c).

* * * * *

UNITED STATES PATENT AND TRADEMARK OFFICE

CERTIFICATE OF CORRECTION

PATENT NO. : 4,086,312

DATED : April 25, 1978

INVENTOR(S) : YOSHIO MIDORIKAWA

It is certified that error appears in the above-identified patent and that said Letters Patent are hereby corrected as shown below:

IN THE ABSTRACT:

Line 5, after "product" insert --for--.

Column 6, lines 5 through 14, the formula should read as follows:

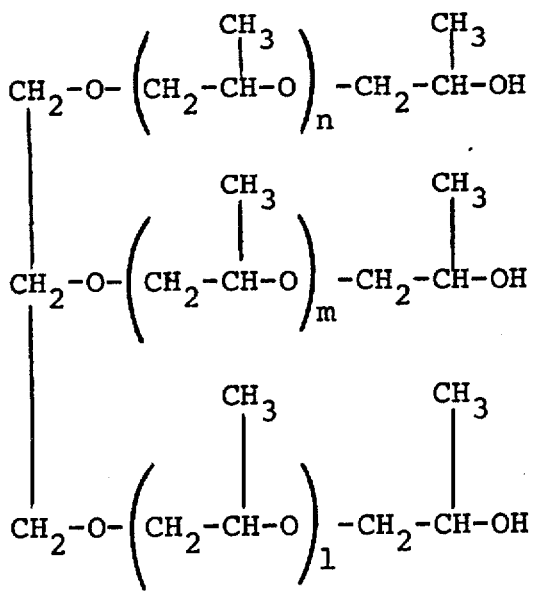

UNITED STATES PATENT AND TRADEMARK OFFICE

CERTIFICATE OF CORRECTION

PATENT NO. : 4,086,312

DATED : April 25, 1978

INVENTOR(S) : YOSHIO MIDORIKAWA

It is certified that error appears in the above-identified patent and that said Letters Patent are hereby corrected as shown below:

Formula at Column 6, lines 5 through 14 Continued:

n, m 1 = 16 - 17

N. W. = 3000

Signed and Sealed this

*Fifth* Day of *December 1978*

[SEAL]

*Attest:*

RUTH C. MASON
*Attesting Officer*

DONALD W. BANNER
*Commissioner of Patents and Trademarks*